US010101132B2

(12) United States Patent
Maydew

(10) Patent No.: US 10,101,132 B2
(45) Date of Patent: Oct. 16, 2018

(54) BARRICADE COMPONENT

(71) Applicant: KARABLOK HOLDINGS LIMITED, Newtown, Powys (GB)

(72) Inventor: Nigel Maydew, Gloucestershire (GB)

(73) Assignee: KARABLOK HOLDINGS LIMITED, Newtown (GB)

( * ) Notice: Subject to any disclaimer, the term of this patent is extended or adjusted under 35 U.S.C. 154(b) by 402 days.

(21) Appl. No.: 14/784,590

(22) PCT Filed: Jan. 14, 2013

(86) PCT No.: PCT/GB2013/050059

§ 371 (c)(1),
(2) Date: Oct. 15, 2015

(87) PCT Pub. No.: WO2014/108661

PCT Pub. Date: Jul. 17, 2014

(65) Prior Publication Data

US 2016/0054102 A1 Feb. 25, 2016

(51) Int. Cl.
*F41H 11/08* (2006.01)
*E01F 13/12* (2006.01)
(Continued)

(52) U.S. Cl.
CPC ..... *F41H 11/08* (2013.01); *E01F 13/12* (2013.01); *E04H 17/16* (2013.01); *E04H 17/18* (2013.01)

(58) Field of Classification Search
CPC ... E01F 13/12; E01F 15/02; E01F 5/00; E01F 5/003; E01F 5/02; E01F 5/04; E01F 5/08;
(Continued)

(56) References Cited

U.S. PATENT DOCUMENTS 1,467,470 A * 9/1923 Borg ..... E02D 5/10 405/262
4,269,026 A * 5/1981 Bulle ..... A44C 5/105 59/82

(Continued)

FOREIGN PATENT DOCUMENTS

WO 2012140651 A2 10/2012

OTHER PUBLICATIONS

International Search Report of PCT Patent Application No. PCT/GB2013/050059 dated Sep. 25, 2013.

(Continued)

*Primary Examiner* — Amber R Anderson
*Assistant Examiner* — Nahid Amiri

(57) ABSTRACT

A barricade component comprises an endless perimeter wall defining a geometric shape in a front-to-back plane. At least two circumferentially spaced-apart connecting lugs are also provided on the perimeter wall which interconnect like or similar barricade components and these extend in an axial top-to-bottom direction. A reinforcement cage is within the perimeter wall and the lugs, and at least one elongate truss extends in a circumferential direction and an axial direction within the wall from one said lug to the other said lug. A method of interconnecting a plurality of said barricade components, and a method of forming such a barricade component are also provided.

10 Claims, 5 Drawing Sheets

(51) Int. Cl.
*E04H 17/16* (2006.01)
*E04H 17/18* (2006.01)

(58) Field of Classification Search
CPC ..... E01F 5/088; E04H 17/16; E04H 17/18; F41H 11/08; A01G 9/022; A01G 9/023; A01G 9/027; A01G 9/028; E02D 29/02; E02D 29/025; E02D 29/0266; E02D 29/0283
USPC ..... 256/25; 404/6; 52/582.1, 585.1, 600, 52/604, 102, 82.1, 591.1, 591.3, 591.4, 52/591.45, 591.5, 607, 609; 47/18, 19.1, 47/39, 66.1, 66.2, 66.3, 65.5, 66.5
See application file for complete search history.

(56) References Cited

U.S. PATENT DOCUMENTS 4,681,302 A * 7/1987 Thompson ..... E01F 8/0035 256/13.1
5,156,485 A 10/1992 Ivey et al.
5,425,594 A 6/1995 Krage et al.
5,651,635 A 7/1997 Nagle
5,685,665 A * 11/1997 Lembo ..... E01F 15/025 256/13.1
6,213,688 B1 * 4/2001 Donkersloot, Sr. ..... E02D 29/0283 403/70
6,418,675 B1 * 7/2002 Peggs ..... A01G 1/08 14/69.5
6,439,801 B1 * 8/2002 Galiana ..... E01F 15/086 256/1
6,669,402 B1 * 12/2003 Davis ..... E01F 15/086 256/13.1
6,913,411 B2 * 7/2005 Yamakawa ..... A44C 5/105 224/164
6,944,998 B1 * 9/2005 King ..... A01G 1/08 47/33
7,144,186 B1 12/2006 Nolte
7,708,492 B2 * 5/2010 Carey ..... E01F 15/025 404/6
7,722,282 B2 * 5/2010 Meidan ..... E01F 15/088 404/6
8,424,258 B2 * 4/2013 Modica ..... A01G 9/027 446/105
8,545,126 B1 * 10/2013 Alsaffar ..... E01F 15/088 256/13.1
8,783,999 B2 * 7/2014 Kulp ..... E01F 15/086 256/13.1
8,864,108 B2 * 10/2014 James ..... E01F 15/085 256/19
2003/0219308 A1 * 11/2003 Boulais ..... E01F 13/024 404/6
2004/0096273 A1 * 5/2004 Yodock, III ..... E01F 15/0453 404/6
2008/0118305 A1 5/2008 Carey
2009/0119987 A1 * 5/2009 Ingrassia ..... A01G 9/028 47/66.5
2009/0250675 A1 * 10/2009 Cashin ..... E01F 13/12 256/13.1
2010/0014914 A1 1/2010 Kulp et al.
2013/0189030 A1 * 7/2013 Miracle ..... E01F 13/048 404/6
2014/0260059 A1 * 9/2014 Riccobene ..... E04B 2/08 52/588.1
2014/0308072 A1 * 10/2014 Sagy ..... E01F 15/025 404/6
2016/0046039 A1 * 2/2016 Hume ..... B28B 7/344 106/638

OTHER PUBLICATIONS

Search Report of British Patent Application No. 1111848.6 dated Nov. 8, 2011.

* cited by examiner

BARRICADE COMPONENT

The present invention relates to a barricade component, to a method of interconnecting a plurality of said barricade components, and to a method of forming such a barricade component.

The prevalence of attacks using vehicles to carry explosives towards and into an intended target has become commonplace. Known barricades fail to halt the vehicles due to their components having relatively weak sub-structures and fragile interconnection.

The present invention seeks to provide a solution to these problems.

According to a first aspect of the invention a barricade component comprising an endless perimeter wall defining a geometric shape in a front-to-back plane, at least two circumferentially spaced-apart connecting lugs on the perimeter wall for interconnecting like or similar barricade components and which extend in an axial top-to-bottom direction, a reinforcement cage within the perimeter wall and the lugs, and at least one elongate truss which extends in at least a circumferential direction within the wall from one said lug to the other said lug.

According to a second aspect of the invention, there is provided a barricade comprising a plurality of interconnected barricade components in accordance with the first aspect of the invention.

Preferably, a single connector pin is utilised for interlayer and intralayer interconnection of a plurality of barricade components.

According to a third aspect of the invention, there is provided a method of interconnecting a plurality of barricade components in accordance with the first aspect of the invention, the method comprising the steps of: a] arranging at least two said barricade components in side-by-side relationship so that corresponding projecting lugs are axially offset so as to be coaxially alignable; b] inserting a or the connector pin into axially aligned connector bores of the aligned lugs; and c] fastening the connector pin in place, wherein the joined barricade components present a barricade having an impact-receiving leading face and a trailing face, said at least one elongate truss of each barricade component extending at least in a wall-portion of its perimeter wall forming the trailing face of the barricade.

According to a fourth aspect of the invention, there is provided a method of forming a barricade component in accordance with the first aspect of the invention, the method comprising the step of providing a mould having the said geometric shape of the perimeter wall, the mould including lug openings for forming the said connecting lugs, at least two adjacent lug openings being provided for each connecting lug, and a blank being provided for blocking at least one of the two adjacent lug openings, wherein a projecting direction of each connecting lug can be selected prior to casting.

The invention will now be more particularly described, by way of example only, with reference to the accompanying drawings, in which.

Figure 1:
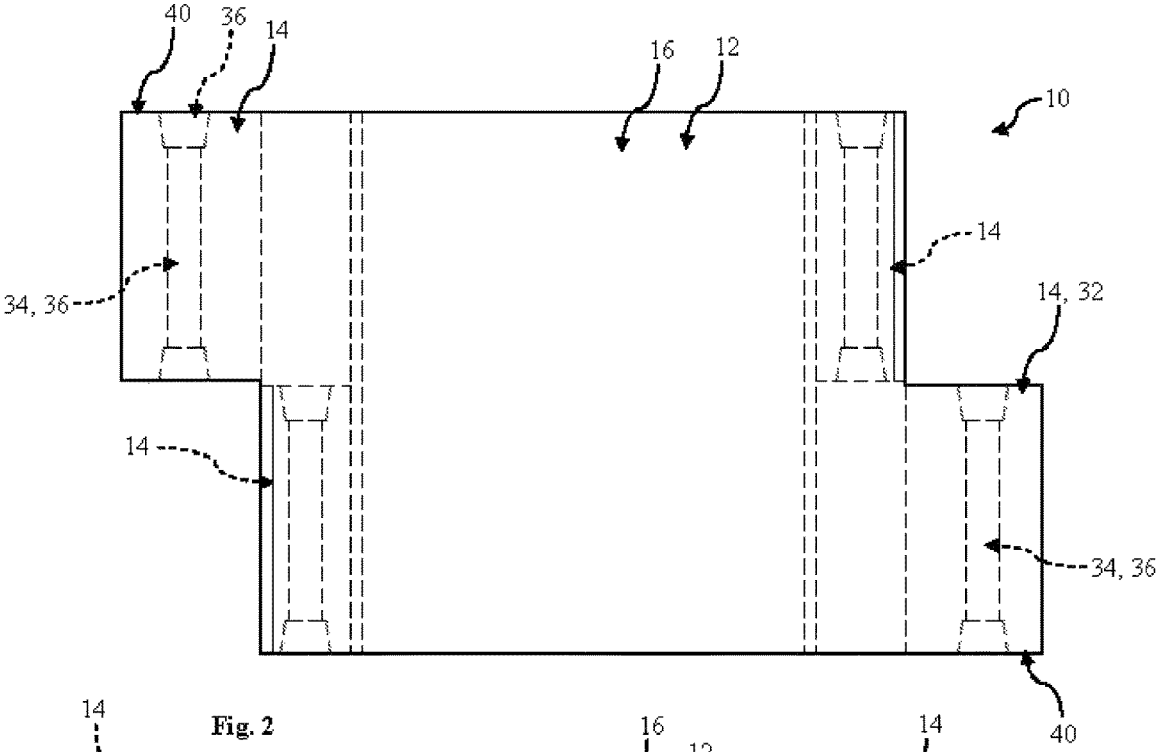
FIG. 1 is a side elevational view of one embodiment of a barricade component, from an impact-receiving leading face and showing optional connecting lug positions in phantom.
Figure 2:
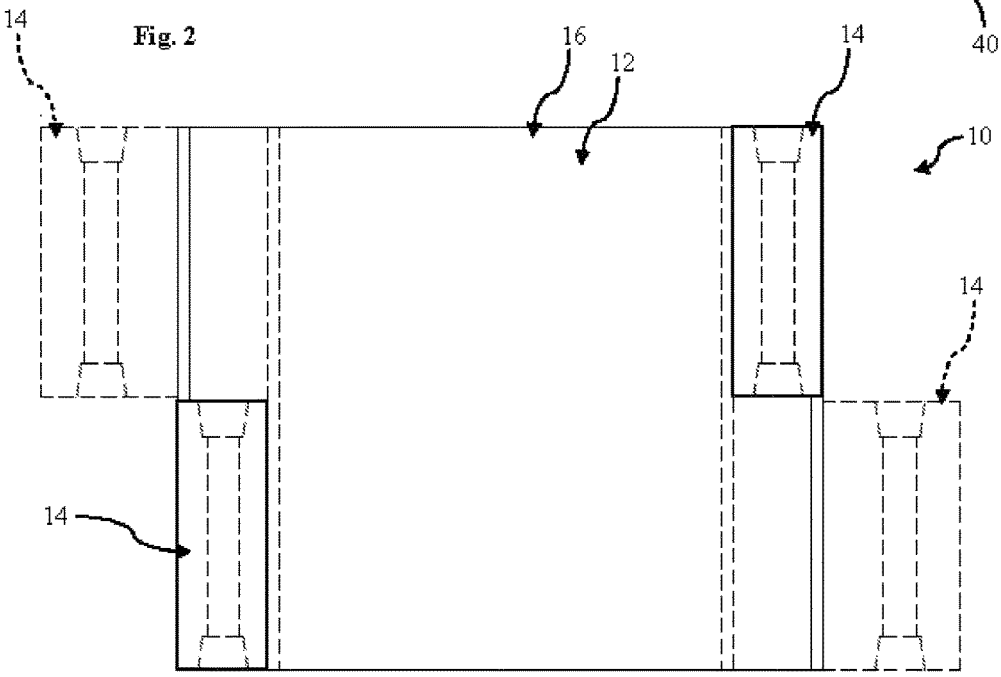
FIG. 2 is a side elevational view of the barricade component, from an intermediate face between the impact-receiving leading face and a trailing face, and again with optional connecting lug positions shown in phantom.
Figure 3:
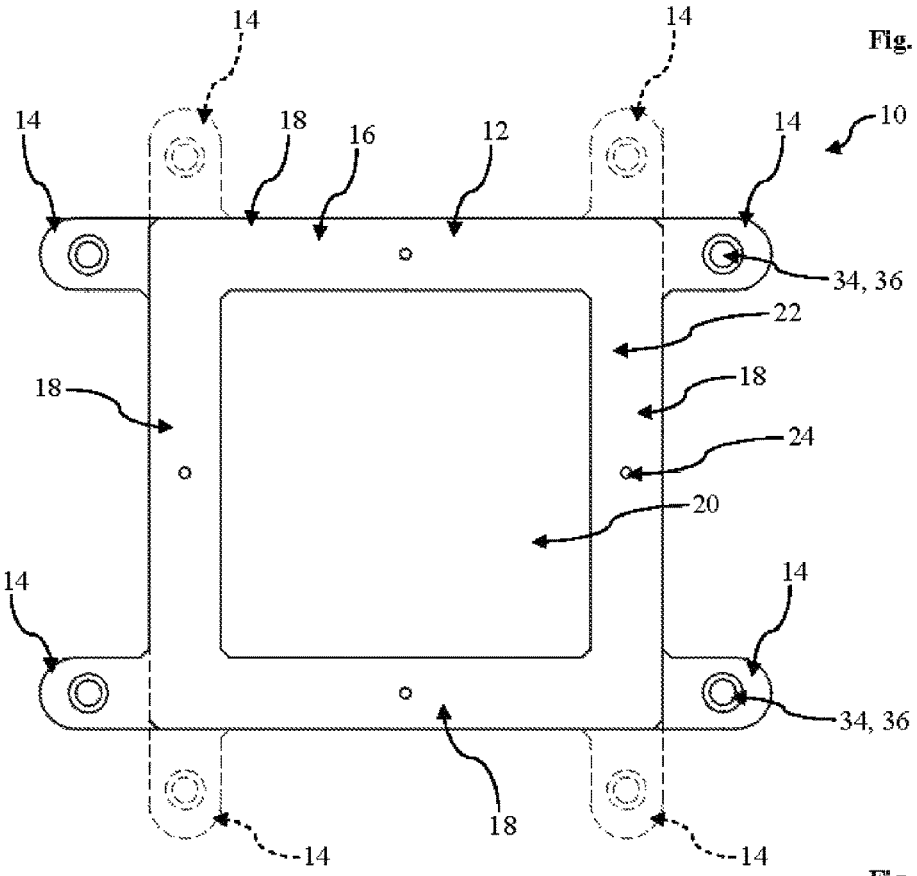
FIG. 3 is a top plan view of the barricade component, with the optional connecting lug positions shown in phantom.

Referring to the drawings, there is shown a barricade component 10 which comprises a component body 12 and at least two connecting lugs 14 which project at spaced apart locations therefrom. In this case, four lugs 14 are provided, and the phantom lines in FIGS. 1 to 6 show optional positions for the lugs 14 depending on the arrangement of the final barricade.

The component body 12 in this embodiment is generally tubular whereby a continuous and preferably unbroken perimeter wall 16 defines a hollow square geometric shape in a front-to-back or horizontal in use plane. Other geometric shapes are possible, such as triangular, rectangular and polygonal. Preferably, the perimeter wall 16 has at least three sides 18, and more preferably at least four sides 18.

The hollow component body 12 defines a central chamber 20 or cavity, which in this case is a uniform bore or aperture through the centre of the component body 12. The chamber 20 extends in an axial top-to-bottom direction or vertically in use. The perimeter wall 16 is preferably of uniform or substantially uniform thickness therearound, excluding the connecting lugs 14. As such, the central chamber 20 has a uniform or substantially uniform cross-section in a front-to-back direction along the axial extent of the component body 12.

The central chamber 20 enables a container to be seated therein. The container may be a planter, for example, to beautify the in use barricade component 10. Additionally or alternatively, the container may be a holder for securely supporting a sign post and/or traffic signal, for example.

A top surface 22, and optionally also a bottom surface of the component body 12 may include a lifting hook or eyelet connector 24 in each side 18 of the perimeter wall 16. Preferably, the lifting hook or eyelet connectors 24 are midway between corners of the component body 12. These enable mechanical lifting, for example by a hoist or crane, of the barricade component 10.

Typical dimensions of the barricade component 10 may be 1.43 meters side to side, 1.43 meters front to back, and 1.2 meters top to bottom. A weight may typically be in the order of 3.25 tonne. Preferably, the component body 12 and connecting lugs 14 are formed using reinforced concrete.

The in use component body 12 presents an impact-receiving leading face 26, a trailing face 28, and two intermediate faces 30. The connecting lugs **14*a* at the leading face 26 are axially offset from each other in a top to bottom direction of the component body 12. Similarly, the connecting lugs 14*b* at the trailing face 28 are also axially offset relative to each other. Finally, the connecting lugs 14*a* and 14*b* across one intermediate face 30** are also offset axially relative to each other.

The connecting lugs 14 preferably also extend in an axial top-to-bottom direction to or substantially to the mid-point of the respective side of the perimeter wall 16. An inner axial end face 32 of each connecting lug 14 at or adjacent to the mid-point of the respective side of the perimeter wall 16 is preferably perpendicular or substantially perpendicular to the outer surface of the perimeter wall 16. However, the inner axial end face 32 of the connecting lug 14 may be at a slight non-perpendicular angle, such as 5 degrees to 10 degrees from perpendicular. This may benefit the accommodation of a camber in the supporting ground when erecting the barricade.

To provide a connector bore 34 axially through each lug 14, a hollow tubular bore former 36 may be utilised. The former 36 may conveniently be plastics or metal. The former 36 lines the connector bore 34 and preferably includes frusto-conical end portions 38 at outer end face portions 40 of each lug which then step down to a cylindrical or substantially cylindrical intermediate portion 42 which extends along a majority of a longitudinal extent of the lug 14. Preferably, at least a majority of the cylindrical or substantially cylindrical intermediate portion 42 of the former 36 is corrugated, and this may be as a helical spiral or separate corrugations. It may be possible to provide only one corrugation or keying point or portion within the connector bore 34 via the former 36, the reasons for which will be better understood hereinafter.

Figure 4:
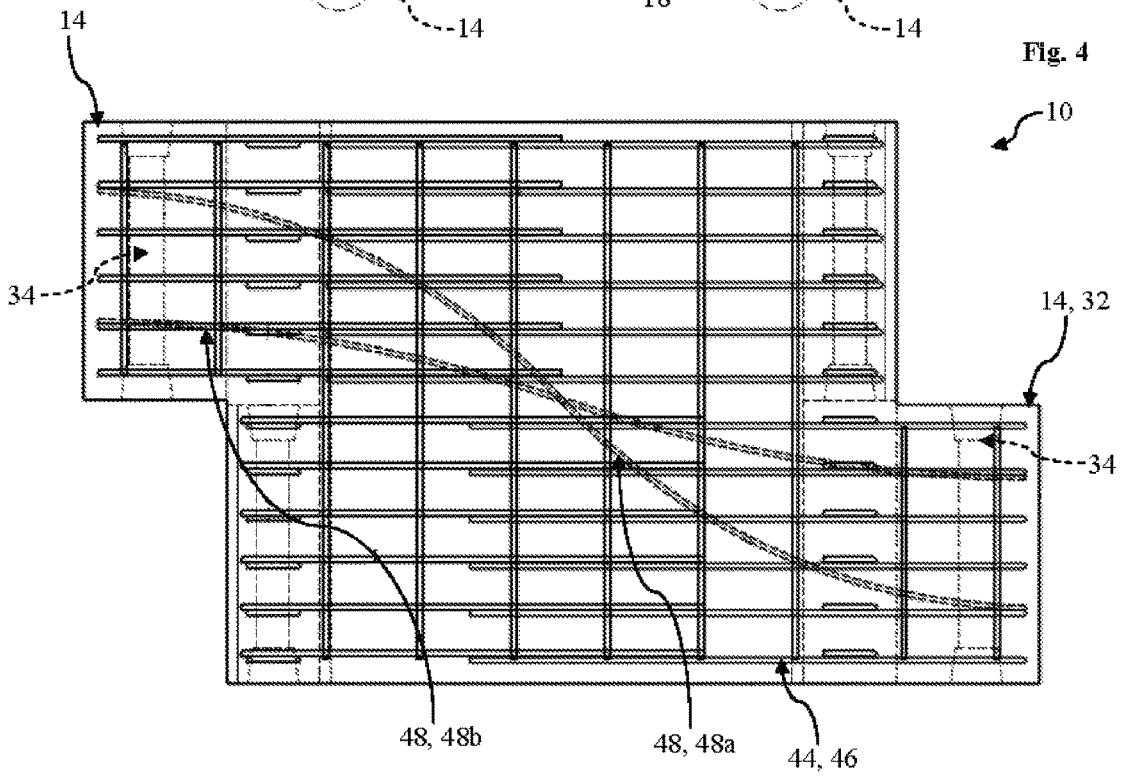
FIG. 4 is a view similar to FIG. 1, but showing an internal reinforcement cage and two internal flexible elongate trusses of the barricade component.
Figure 5:
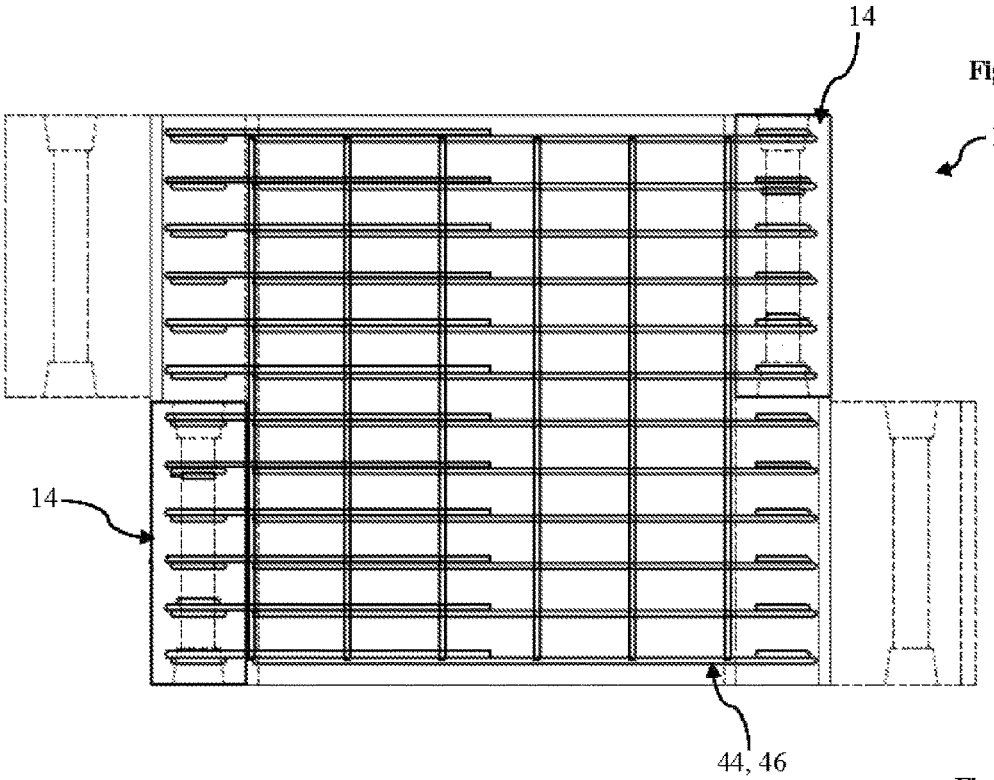
FIG. 5 is a view similar to FIG. 2, showing the internal reinforcement cage.
Figure 6:
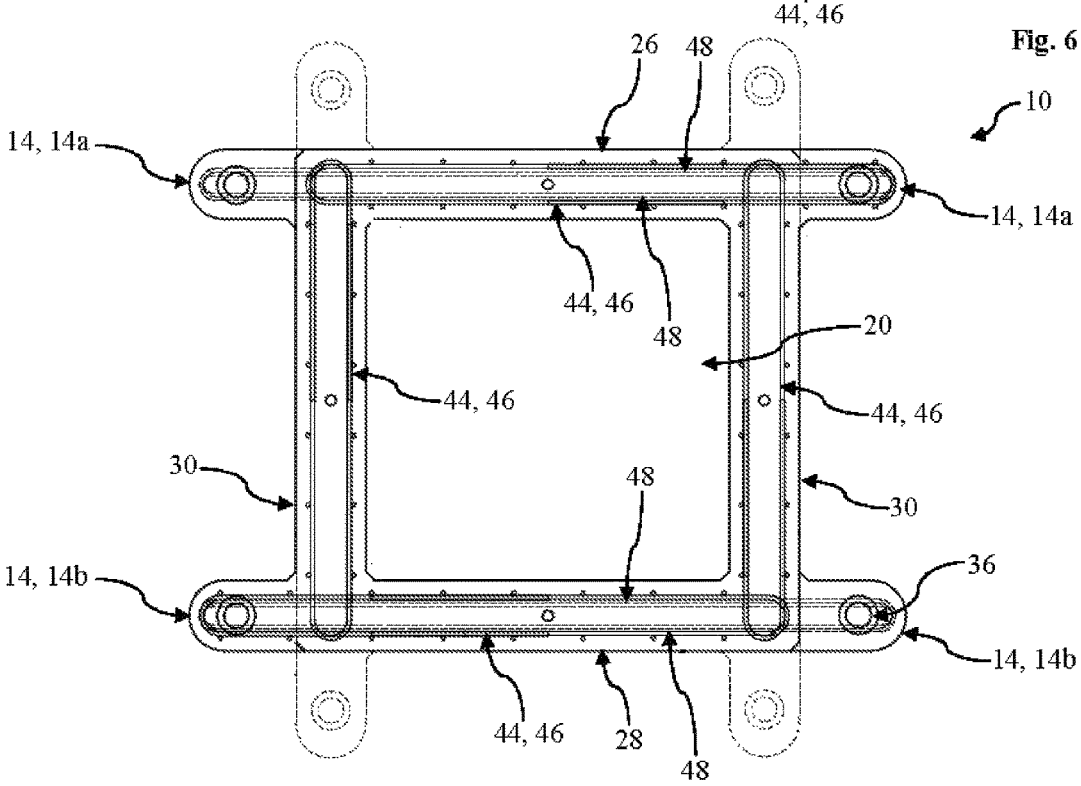
FIG. 6 is a view similar to FIG. 3, showing the internal reinforcement cage and internal flexible elongate trusses in plan.
Figure 7:
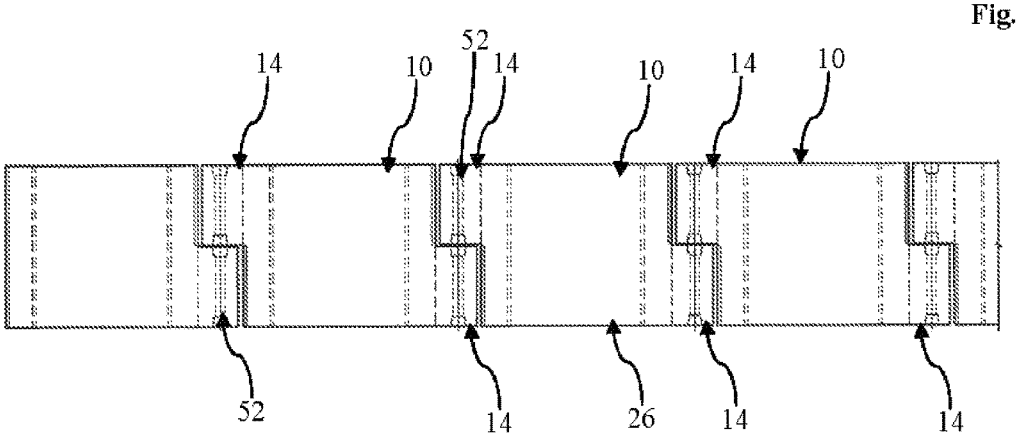
FIG. 7 is a side elevational view showing a plurality of similar barricade components interconnected to form a barricade.

A reinforcement cage 44 is provided within the perimeter wall 16, and the cage 44 extends into the connecting lugs 14. The reinforcement cage 44 is preferably formed from rigid elongate struts, such as steel rebar or similar rigid, typically metal, rod-like material. As best seen in FIGS. 4 to 6, the elongate struts extend in use vertically and horizontally to form a double-walled framework 46, and this double-walled framework 46 extends continuously along each side of the perimeter wall 16 and into each projecting connecting lug 14.

To further reinforce the cage 44, two elongate trusses 48 also extend within sides of the perimeter wall 16 between pairs of connecting lugs 14, as best seen in FIG. 4. Two said elongate trusses 48 therefore preferably extend in the side of the perimeter wall 16 presenting the impact-receiving leading face 26, and two said elongate trusses 48 preferably extend in the side of the perimeter wall 16 presenting the trailing face 28. Optionally, further trusses may be provided extending within the sides of the perimeter wall 16 presenting the intermediate faces 30.

In this case, each truss 48 is flexible, and may include a swaged eyelet at each end through which the former 36 of the respective lug 14 extends. Each truss 48, if flexible, may be a multi-stranded metal cable. Alternatively, each truss 48 may be a rigid bar having an eyelet or hook at each end for location around the former 36. Termination of each truss in the lugs is essential.

Each truss 48 extends circumferentially within the perimeter wall 16, but also in an axial or top-to-bottom direction. In the present embodiment, utilising a flexible truss 48, the truss 48 follows a sine-wave path, allowing for some slack within the perimeter wall 16.

Also in this embodiment, the two trusses 48 cross partway along their longitudinal extents. A first truss 48*a* extends from a position adjacent to an outer end face 40 of a first lug 14, across the leading face 26 of the perimeter wall 16 and to a position adjacent to an outer end face 40 of a second lug 14. A second truss 48*b* extends from a position adjacent to the inner end face 32 of the first lug 14, across the leading face 26 of the perimeter wall 16 and crossing the first truss 48*a* , to terminate at a position adjacent to the inner end face 32 of the second lug 14.

Preferably, the first truss 48*a* may be on the outside of the reinforcement cage 44 towards the exterior of the perimeter wall 16, and the second truss 48*b* may be on the outside of the reinforcement cage 44 towards the interior of the perimeter wall 16, or vice versa. Alternatively, the trusses 48 may be within the double-walled reinforcement cage 44. Furthermore, one truss 48 may be outside of the reinforcement cage 44, and one truss 48 may be within the reinforcement cage 44.

The trusses 48 at the trailing face 28 of the perimeter wall 16 may be similarly arranged.

Further trusses may be provided in the perimeter wall 16 of the intermediate faces 30, and in this case all of the connecting lugs 14 are interconnected via the trusses 48.

If ends with swaged eyelets are not utilised, then preferably the trusses 48 may be continuous, extending one or more times around a respective former 36 of a connecting lug 14 before extending back along the perimeter wall 16 defining the respective face.

Each truss 48, especially with slack, allows dissipation of the force of an impact to the lugs 14 and from there to adjacent interconnected barricade components 10.

It may be possible to provide only one truss 48 at the trailing face 28 of the component body 12, with the other trusses being dispensed with. At least one truss 48 at the trailing face 28 is preferable, since this potentially provides the least amount of slack prior to force dissipation through tensioning, when the geometric shape of the component body 12 changes or collapses following an impact at the leading face 26.

It is also possible to provide counter-directed said trusses 48, one which extends from a top portion of a top lug 14 on one side of the leading face 26 to a bottom portion of a top lug 14 on the same side of the body 12 of the trailing face 28, and the other truss 48 which extends from a top portion of a bottom lug 14 on the other side of the leading face 26 to a bottom portion of a bottom lug 14 on the same side of the body 12 of the trailing face 28. This arrangement allows each truss 48 to extend along the leading face 26, trailing face 28 and a different intermediate face 30.

By optionally providing connecting lugs 14 being coplanar or horizontally aligned on the intermediate sides, whilst on opposing intermediate sides being axially offset, barricade components 10 can be lowered into place by a crane or hoist and neighbouring lugs 14 can be easily axially aligned.

If the lugs are coplanar across the leading face and/or the trailing face, in other words being in use horizontally aligned, then the or each truss may not necessarily move in the axial direction. For example, each truss may have its ends connected at the respective lugs horizontally or substantially horizontally aligned. However, even with coplanar lugs being interconnected by one or more trusses, it is still feasible to have axial orientation of the or each truss. For example, one end of the truss may be at or adjacent to the outer end face of a first lug, and the other end of the truss may be at or adjacent to the inner end face of the second lug. Thus, even if the lugs are coplanar, the truss may still extend in a circumferential direction and in an axial direction.

Figure 8:
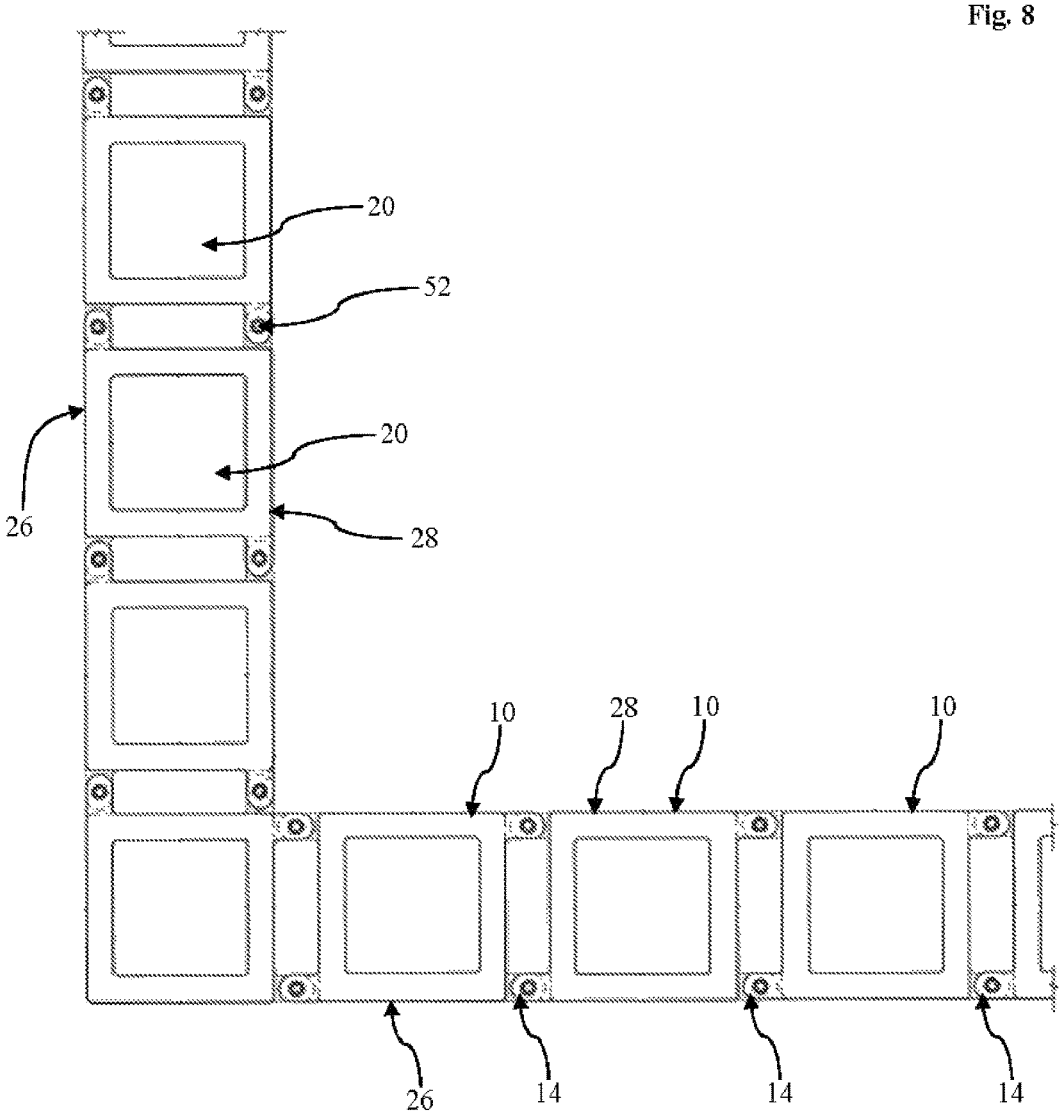
FIG. 8 is a plan view of the interconnected barricade components of FIG. 7.
Figure 9:
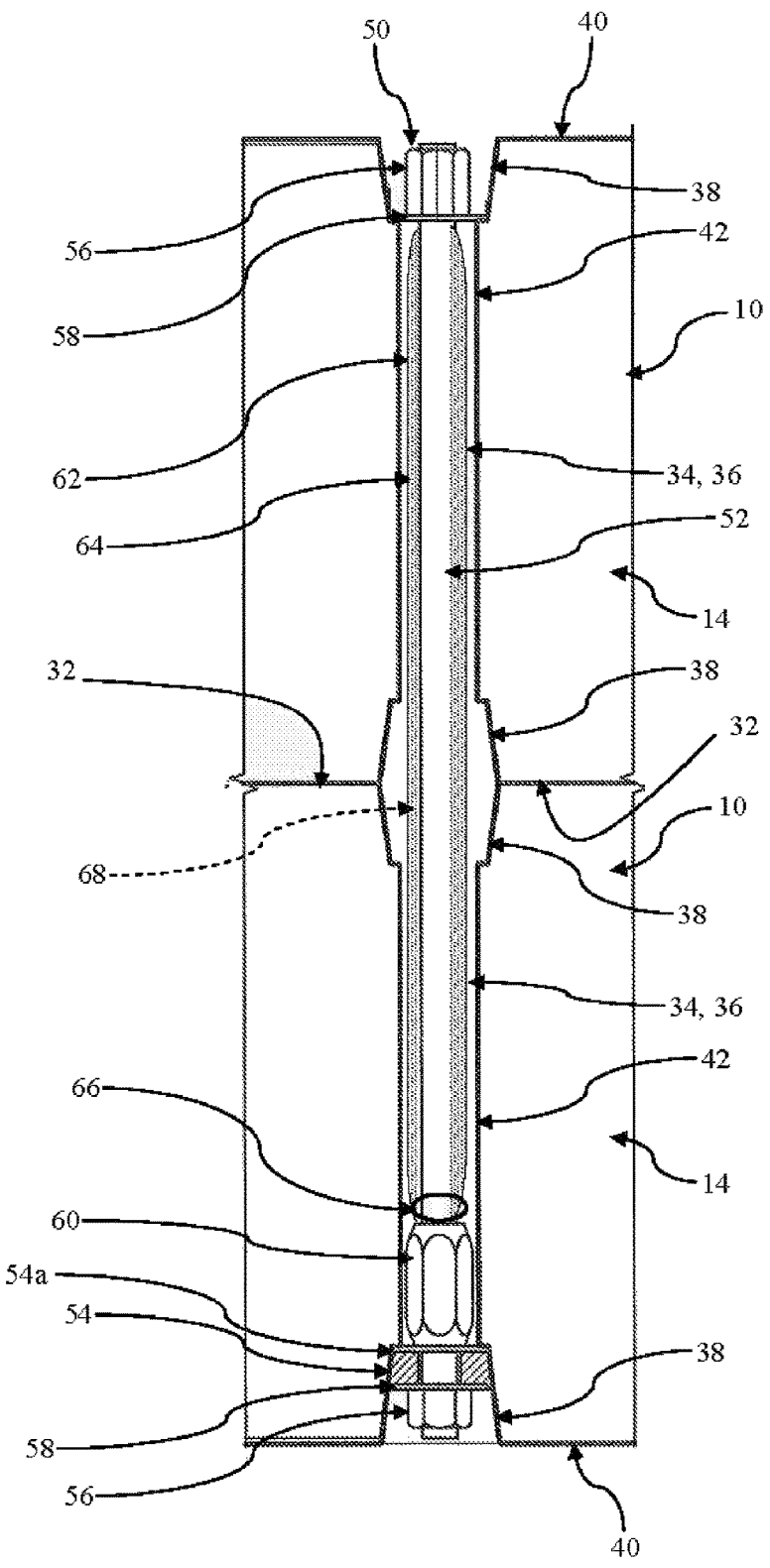
FIG. 9 is an enlarged side elevational view of two axially aligned connecting lugs of two neighbouring retaining components shown in FIG. 7, and showing a lug connector device interconnecting the two lugs.

To interconnect axially aligned lugs 14 of neighbouring barricade components 10, once arranged as shown in FIGS. 8 and 9, a lug connector device 50 is utilised. The lug connector device 50 comprises a rectilinear elongate rigid connector pin 52, formed for example from threaded rebar, at least one shock absorption element 54, and a nut and washer 56, 58 for each end. A Macalloy RTM connector 60 may be used at one or more ends to enable interconnection of stacked barricade components 10. The Macalloy RTM connector 60 provides a threaded opening for receiving the end of a further connector pin 52 which interconnects neighbouring barricade components 10 of the layer stacked above. A further washer 58*a* supports the shock absorption element 54 against the shoulder of the frusto-conical portion of the bore 34. By interlayer connection of connector pins 52, intralayer and interlayer interconnection of the barricade components 10 is possible, further rigidifying the barricade structure.

The shock absorption element 54 is preferably a plastics, such as polyurethane, bung or thick washer. The shock absorption element 54 is dimensioned to be received as a close fit within the frusto-conical end portion 38 of the former 36 at the outer end face 40 of the connecting lug 14. The bore diameter of the former 36 is greater than that of the connector pin 52. As such, the shock absorption element 54 centralises and supports the connector pin 52 once slidably received therethrough.

Retaining apparatus 62 is utilised to hold the connector pin 52 securely in the axially aligned connecting lugs 14, whereby the nuts 56 connecting the ends of the connector pin 52 to the lugs are not the only means for holding the connector pin 52 in place when interengaging neighbouring barricade components 10. The retaining apparatus 62 includes the previously mentioned former 36 which lines and reinforces the axial bore of each lug 14, along with a pliantly flexible, preferably plastics or rubber, tube 64 which extends along at least a majority of the longitudinal extent of the connector pin 52. The pliantly flexible tube 64 is at least substantially liquid tightly sealed at its lower end to or adjacent to a lower end of the connector pin 52. Conveniently, one or more elastic, such as rubber, rings 66 can be used as fasteners. With the connector pin 52 and pliantly flexible tube 64 extending through respective lugs 14 of neighbouring barricade components 10, a flowable material 68, such as grout, which in this case is settable, is poured into the pliantly flexible tube 64 and around the connector pin 52. The weight of the flowable material 68 expands the pliantly flexible tube 64 outwardly to engage the or each corrugation or keying surface of the formers 36 in the lugs 14. Due at least in part to the preferable undulations and or threads along the longitudinal extent of the connector pin 52, the flowable material 68, particularly once set, securely grips and holds the connector pin 52 in place. It has been found that even using a non-settable material, such as water, makes removal of the connector pin 52 once the nuts 56 are removed from the ends extremely difficult if not impossible without a mechanical aid.

With interlayer and/or intralayer interengagement of at least two barricade components 10, a bracket can be accommodated between inner axial end faces 32 of two aligned connecting lugs 14. Conveniently, the bracket comprises a plate-like tongue which can be received between the inner axial end faces 32. The plate-like tongue also includes an aperture to allow the connector pin 52 to pass therethrough. A projecting end of the plate-like tongue may include any suitable mounting element to allow the holding of a sign post, sign and/or mast, for example.

Each barricade component 10 is preferably cast using reinforced concrete. A mould is formed to the required geometric shape of the perimeter wall 16. If the central chamber 20 is required, then a suitable blank is inserted. The mould walls preferably incorporate at least two adjacent lug openings for each connecting lug 14. The lug openings in this case are at right angles or substantially right angles to each other. A projecting direction of each connecting lug 14 is thus selected prior to casting, and a lug blank is then utilised to block the remaining one of the two adjacent lug openings. With the reinforcement cage 44 inserted into the mould and the formers 36 for the connector bores 34 positioned in the lug openings, concrete or another suitable settable or castable material is poured into the mould and left to set and cure.

To enable corners to be included in a train of interconnected barricade components, a triangular or trapezoidal barricade component can be formed. However, for right angled corners, simply selecting the appropriate lug openings in the mould will enable a square or rectangular barricade component to be utilised.

Although four lugs have been suggested, as few as two can be utilised. However, in this case the truss or trusses interconnect the two lugs, and it is preferable that the or each truss extends at least across the side of the perimeter wall defining the in use trailing face away from the impact-receiving leading face.

It is preferable that the trusses overlap or cross along their longitudinal extents, even if there is no contact. This is beneficial in strengthening the whole structure. However, the trusses may extend in parallel with each other.

It is thus possible to provide a barricade component which has an endless perimeter wall defining a geometric shape in an in use horizontal plane. By providing interior reinforcement both within the wall and the connecting lugs, the strength at the point of interconnection is significantly improved. By the addition of at least one elongate truss which extends along the perimeter wall in both a circumferential direction and an axial direction and which interconnects at least two interconnecting lugs, energy dissipation into like neighbouring interconnected barricade components following an impact is greatly improved. It therefore becomes significantly more difficult for a vehicle to break through such a barricade. Furthermore, due to the central chamber, the barricade can be beautified to make it more aesthetically pleasing and/or to hold signage and the like.

The embodiments above are provided by way of examples only, and various other modifications will be apparent to persons skilled in the field without departing from the scope of the invention as defined by the appended claims.

The invention claimed is:

1. A barricade component comprising a perimeter wall defining a geometric shape in a front-to-back plane, at least two circumferentially spaced-apart connecting lugs on the perimeter wall which extend in an axial top-to-bottom direction, a reinforcement cage within the perimeter wall and the lugs, and at least one elongate truss which extends in at least a circumferential direction within the wall from one of the lugs to other of the lugs, wherein the perimeter wall defines a central chamber which extends in a top-to-bottom axial direction, the central chamber having a uniform or substantially uniform cross-section in a front-to-back direction along the axial extent and/or the central chamber being an axially extending aperture through the barricade component.

2. The barricade component as claimed in claim 1, wherein the lugs comprises a first lug, a second lug, a third lug and a fourth lug, two of the first lug, the second lug, the third lug and the fourth lug being on opposing sides, one said truss extending in a circumferential direction and an axial direction within the wall from the first lug to the second lug on a same side via an opposing side, and another said truss extending in a circumferential direction and an axial direction within the wall from the third lug to the fourth lug on a same side via an opposing side.

3. The barricade component as claimed in claim 1, wherein each said lug includes an axial connector bore which is stepped to form a stepped bore to receive a connector pin, the stepped bore having frusto-conical end portions stepping down to a cylindrical or substantially cylindrical intermediate portion.

4. The barricade component as claimed in claim 3, further comprising a lug connector device comprising the connector pin and at least one shock-absorption element, the connector pin being holdable coaxially or substantially coaxially within the stepped bore by the shock absorption element and/or the shock absorption element being a bung for receipt in the stepped bore.

5. The barricade component as claimed in claim 3, further comprising connector pin retaining apparatus which holds the connector pin within the stepped bore.

6. The barricade component as claimed in claim 5, wherein the retaining apparatus further includes a pliantly flexible tube in which at least a majority of the connector pin is receivable, the pliantly flexible tube being connectable to the connector pin at or adjacent to one end.

7. The barricade component as claimed in claim 6, wherein the retaining apparatus further includes a flowable material which is receivable in the pliantly flexible tube, whereby expansion of the pliantly flexible tube within the stepped bore of the lug grips the connector pin in place.

8. The barricade component as claimed in claim 1, wherein at least two said lugs are axially offset in a top-to-bottom direction.

9. The barricade component as claimed in claim 1, wherein the reinforcement cage extends into each connecting lug.

10. The barricade comprising a plurality of interconnected barricade components as claimed in claim 1, wherein a single connector pin is utilised to enable interlayer and intralayer interconnection of a plurality of barricade components.

* * * * *